US009856098B2

(12) United States Patent
Kuwata

(10) Patent No.: US 9,856,098 B2
(45) Date of Patent: Jan. 2, 2018

(54) FEEDING APPARATUS AND IMAGE FORMING APPARATUS

(71) Applicant: CANON KABUSHIKI KAISHA, Tokyo (JP)

(72) Inventor: Takashi Kuwata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/277,920

(22) Filed: Sep. 27, 2016

(65) Prior Publication Data

US 2017/0015513 A1 Jan. 19, 2017

Related U.S. Application Data

(63) Continuation of application No. 14/789,854, filed on Jul. 1, 2015, now Pat. No. 9,481,532.

(30) Foreign Application Priority Data

Jul. 7, 2014 (JP) ..... 2014-139873

(51) Int. Cl.
*B65H 1/14* (2006.01)
*B65H 1/04* (2006.01)
(Continued)

(52) U.S. Cl.
CPC ..... *B65H 1/14* (2013.01); *B65H 1/04* (2013.01); *B65H 1/266* (2013.01); *B65H 3/0615* (2013.01); *B65H 3/0669* (2013.01); *B65H 3/0684* (2013.01); *B65H 7/00* (2013.01); *B65H 7/02* (2013.01); *B65H 2403/411* (2013.01); *B65H 2403/53* (2013.01);
(Continued)

(58) Field of Classification Search
CPC ..... B65H 2403/53; B65H 2405/114; B65H 2405/1142; B65H 2405/11425; B65H 1/14; B65H 1/266; B65H 3/0684; B65H 3/0669; B65H 3/0615
USPC ..... 271/121
See application file for complete search history.

(56) References Cited

U.S. PATENT DOCUMENTS 5,501,444 A * 3/1996 Yukimachi ..... B65H 1/14 271/10.11
6,299,157 B1 * 10/2001 Lim ..... B65H 3/0669 271/109

(Continued)

*Primary Examiner* — Patrick Cicchino
(74) *Attorney, Agent, or Firm* — Canon U.S.A., Inc. IP Division

(57) ABSTRACT

A feeding apparatus includes a stacking member provided to a feeding cassette, a feeding member, a contact portion provided on a regulating member provided on the feeding cassette, a movement unit, and a switching unit. The movement unit raises the feeding member when the feeding cassette is pulled out and lowers the feeding member when the feeding cassette is inserted. The switching unit switches a positional relationship between the feeding and stacking member. After the feeding member is lowered and before the feeding member performs a sheet feeding operation, the switching unit switches the relationship to the second positional relationship from the first. When a stacked sheet amount is equal to or more than a predetermined amount, the contact portion is disposed in contact with the stacked sheets and when the amount is smaller than the predetermined amount, the contact portion is disposed not in contact with the stacked sheets.

18 Claims, 14 Drawing Sheets

(51) Int. Cl.

| | |
|---|---|
| ***B65H 7/00*** | (2006.01) |
| ***B65H 3/06*** | (2006.01) |
| ***B65H 7/02*** | (2006.01) |
| ***B65H 1/26*** | (2006.01) |

(52) U.S. Cl.
CPC ..... *B65H 2405/11425* (2013.01); *B65H 2511/10* (2013.01); *B65H 2511/20* (2013.01); *B65H 2511/212* (2013.01); *B65H 2511/51* (2013.01)

(56) References Cited

U.S. PATENT DOCUMENTS

| | | | | |
|---|---|---|---|---|
| 8,991,814 | B2 * | 3/2015 | Hirahara | B65H 3/0684 271/117 |
| 2008/0128973 | A1 * | 6/2008 | Hirose | B65H 3/0684 271/117 |
| 2009/0243206 | A1 * | 10/2009 | Ueyama | B65H 1/266 271/264 |
| 2010/0148430 | A1 * | 6/2010 | Fuda | B65H 1/04 271/241 |
| 2011/0013973 | A1 * | 1/2011 | Kusumi | B65H 1/266 403/119 |
| 2011/0156342 | A1 * | 6/2011 | Iino | B65H 3/0684 271/10.11 |
| 2012/0119434 | A1 * | 5/2012 | Ueda | B65H 1/04 271/147 |
| 2015/0097330 | A1 * | 4/2015 | Sato | B65H 1/14 271/160 |

* cited by examiner

FEEDING APPARATUS AND IMAGE FORMING APPARATUS

CROSS-REFERENCE TO RELATED APPLICATION

This application is a Continuation of U.S. application Ser. No. 14/789,854, filed Jul. 1, 2015, which claims priority from Japanese Patent Application No. 2014-139873 filed Jul. 7, 2014, which are hereby incorporated by reference herein in their entireties.

BACKGROUND OF THE INVENTION

Field of the Invention

The present invention relates to a feeding apparatus and an image forming apparatus.

Description of the Related Art

Generally, recent image forming apparatuses, such as a copier, a printer, and a fax machine, include a feeding cassette that is detachably attached to an apparatus main body and accommodates sheets.

There is one type of the feeding cassette including a stacking plate that can be raised and lowered and presses stacked sheets against a feeding roller. A feeding cassette, discussed in Japanese Patent Application Laid-Open No. 2012-56670, is provided with a slidable trailing edge regulating member. The trailing edge regulating member regulates a position of a trailing edge of sheets, which is stacked on the stacking plate, in a feeding direction. Thus, sheets of different sizes can be used. The feeding cassette, discussed in Japanese Patent Application Laid-Open No. 2012-56670, is further provided with a slidable side end regulating member pair. The side end regulating member pair regulates the side end positions of sheets, which is stacked on the stacking plate, in a direction (hereinafter, referred to as a width direction) orthogonal to the feeding direction.

However, the configuration discussed in Japanese Patent Application Laid-Open No. 2012-56670 has the following problem. Specifically, when the feeding cassette is inserted into the image forming apparatus in a state where an amount of sheets stacked on the stacking plate is equal to or more than a full stacked amount (equal to or more than a predetermined amount), a pickup roller might come into contact with the uppermost sheet during the inserting operation, due to an insufficient distance between the pickup roller and the uppermost sheet on the stacking plate.

When the stacking plate comes into contact with the uppermost sheet during the inserting operation of the feeding cassette, the uppermost sheet and the adjacent sheet stop on an upstream side in the insertion direction of the feeding cassette (front side), and thus are not set at proper positions. If a feeding operation of sheet is performed in this state, the position of an image with respect to the sheet might be deviated, and a paper jam might occur due to collision of the sheet with a guide and the like on a conveyance path.

SUMMARY OF THE INVENTION

The present invention is directed, in view of the situation described above, to reduction of position deviation of sheet when a feeding cassette is inserted into an apparatus main body in a state where the amount of sheets stacked on the stacking plate is equal to or more than a predetermined amount (a state where an uppermost one of the sheets stacked on the stacking plate is positioned at or higher than a predetermined position). In an example, a CPU controls rotation of a motor based on an insertion detection unit detecting that a feeding cassette is inserted into an image forming apparatus. The CPU rotates the motor in a reverse direction to move a pickup roller to a second position, whereby the pickup roller is temporarily separated from a sheet. Then, the CPU rotates the motor in a normal direction, whereby the pickup roller moves to a first position to be in contact with the sheet again.

According to an aspect of the present invention, a feeding apparatus includes an apparatus main body, a feeding cassette configured to be inserted into and pulled out from the apparatus main body, a stacking member provided to the feeding cassette and configured to have sheets stacked on the stacking member, a feeding member configured to be raised and lowered and to feed the sheets stacked on the stacking member, a regulating member provided on the feeding cassette and configured to move and regulate a position of the sheets stacked on the stacking member, a contact portion provided on the regulating member and configured to come into contact with the sheets stacked on the stacking member, an elastic portion configured to elastically bias the contact portion toward the sheets stacked on the stacking member, a first movement unit configured to raise the feeding member in accordance with an operation of pulling the feeding cassette out from the apparatus main body, and to lower the feeding member in accordance with an operation of inserting the feeding cassette into the apparatus main body, a switching unit that includes a driving source configured to generate driving force and is configured to use the driving force of the driving source to switch a positional relationship between the feeding member and the stacking member between a first positional relationship and a second positional relationship, wherein the feeding member and the stacking member are disposed farther apart from each other in the second positional relationship than in the first positional relationship, and a control unit configured to control, after the feeding member is lowered in response to insertion of the feeding cassette into the apparatus main body and before the feeding member performs a feeding operation of the sheets, the switching unit in such a manner that the positional relationship between the feeding member and the stacking member is switched to the second positional relationship from the first positional relationship, wherein, in a case where an amount of sheets stacked on the stacking member is equal to or more than a predetermined amount, the contact portion is disposed at a position in contact with the sheets stacked on the stacking member, and wherein, in a case where the amount of sheets stacked on the stacking member is smaller than the predetermined amount, the contact portion is disposed at a position not in contact with the sheets stacked on the stacking member.

Further features of the present invention will become apparent from the following description of exemplary embodiments with reference to the attached drawings.

DESCRIPTION OF THE EMBODIMENTS

A first exemplary embodiment to which the present invention is applied is described in detail with reference to the drawings.

Figure 1:
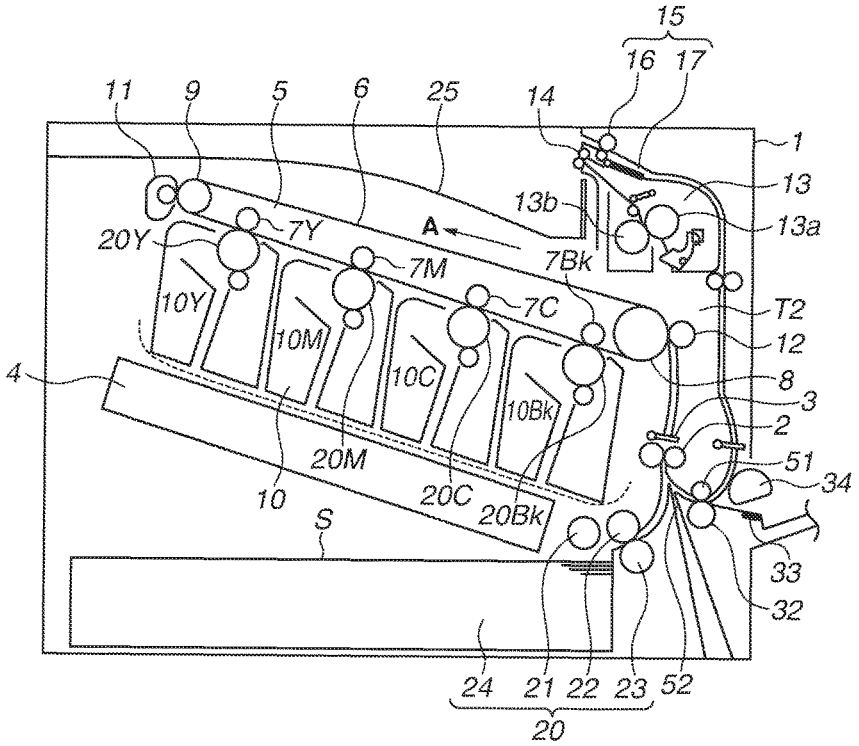
FIG. 1 is a cross-sectional view illustrating an image forming apparatus according to a first exemplary embodiment.

FIG. 1 is a vertical cross-sectional view illustrating an overall configuration of a full-color laser beam printer as one aspect of an image forming apparatus to which the first exemplary embodiment is applied.

As illustrated in FIG. 1, a feeding apparatus 20 that feeds a sheet S is disposed in a lower portion of an image forming apparatus (apparatus main body) 1. The feeding apparatus 20 includes, in an upper portion, a registration roller pair 2 that conveys the sheet S with a timing synchronized with an image, and a top sensor (detection unit) 3 that detects a position of the sheet S and a paper jam.

A scanner unit 4 is disposed on an upper side of the feeding apparatus 20. Four process cartridges 10 (10Y, 10M, 10C, and 10Bk) are disposed on an upper side of the scanner unit 4. An intermediate transfer unit 5 is disposed on an upper side of the process cartridges 10 (10Y, 10M, 10C, and 10Bk) and faces the process cartridges 10 (10Y, 10M, 10C, and 10Bk). The intermediate transfer unit includes an intermediate transfer belt 6 as well as primary transfer rollers 7 (7Y, 7M, 7C, and 7Bk), a driver roller 8, and a tension roller 9 that are disposed on the inner side of the intermediate transfer belt 6, and a cleaning unit 11. A secondary transfer roller 12 is disposed on the right side of the intermediate transfer unit 5 and faces the driver roller 8. A fixing unit 13 is disposed on the upper side of the intermediate transfer unit 5 and the secondary transfer roller 12. A discharge roller pair 14 and a two-sided-reversing unit 15 are disposed on an upper left side of the fixing unit 13. The two-sided-reversing unit 15 includes a reversing roller pair 16 and a two-sided flapper 17 as a branching unit.

An operation of the image forming apparatus 1 will be described.

The image forming apparatus 1 illustrated in FIG. 1 sequentially transfers (primary transfer) toner images, of respective colors, which are formed by the scanner unit 4, photosensitive drums (20Y, 20M, 20C, and 20Bk), and the like, onto the intermediate transfer belt 6 rotating in the anticlockwise direction (A direction). Thus, the toner images of respective colors are superimposed on top of the other, whereby a full-color toner image is formed on the intermediate transfer belt 6.

The sheets S accommodated in a feeding cassette 24 are picked up (fed) by a pickup roller (feeding member) 21, and are separated from each other and conveyed to the registration roller pair 2 by a feed roller 22 and a separation roller 23.

The leading edge of the sheet S, conveyed by the registration roller pair 2, is detected by the top sensor 3. Then, the sheet S is conveyed to a secondary transfer portion T2 with a timing (position of the sheet S) synchronized with the toner image on the intermediate transfer belt 6. The sheet S on which the toner image has been transferred at the secondary transfer portion T2 is conveyed to the fixing unit 13.

At the fixing unit 13, the toner image is fixed on the sheet S by a pressing roller 13*a* and a heating roller 13*b*. The sheet S on which the toner image has been fixed is discharged onto a discharge tray 25 in an apparatus upper portion by the discharge roller pair 14.

Figure 14:
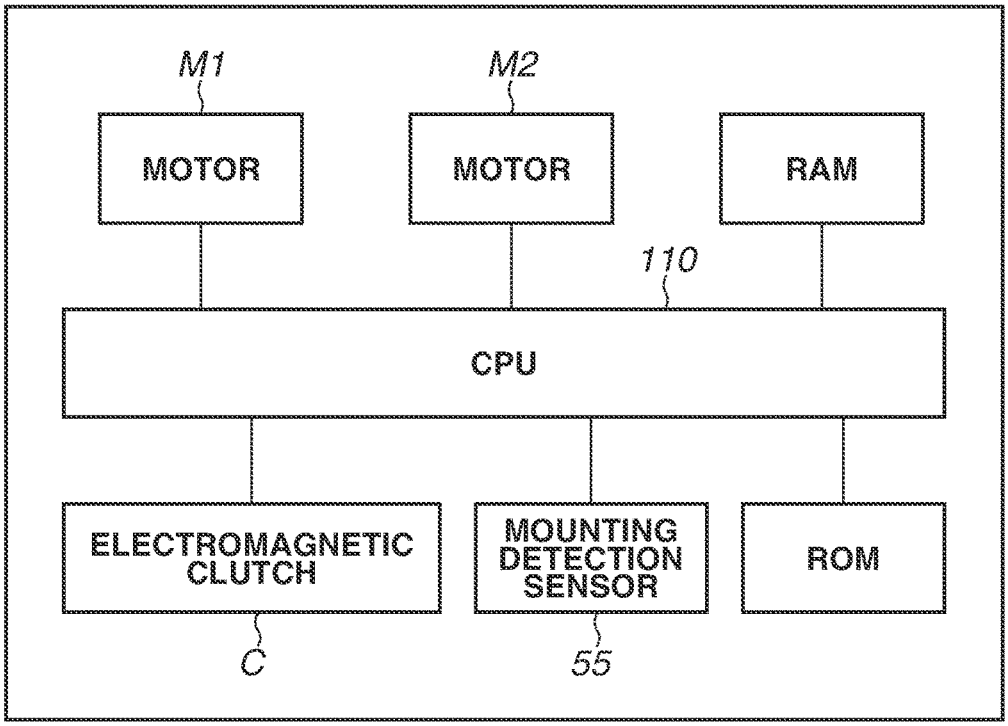
FIG. 14 is a block diagram illustrating the image forming apparatus.

FIG. 14 is a block diagram of the image forming apparatus 1. As illustrated in FIG. 14, a central processing unit (CPU) 110 is connected to a motor (driving source) M1, a motor M2, an electromagnetic clutch C, and an insertion detection unit 55 that are described later. The CPU 110 is connected to a read only memory (ROM) and a random access memory (RAM), and uses the RAM as a work memory to execute a program stored in the ROM. According to the first exemplary embodiment, the CPU 110, the ROM, and the RAM form a control unit.

The feeding apparatus 20 according to the first exemplary embodiment is described with reference to FIGS. 1 to 12.

The feeding apparatus 20 includes the feeding cassette 24 that can be mounted to and pulled out from the image forming apparatus (apparatus main body) 1, the pickup roller 21, the feed roller 22, and the separation roller 23. The sheets S fed by the pickup roller 21 are separated into individual pieces at a separation nip formed of the feed roller 22 and the separation roller 23 in pressure contact with the feed roller 22, and are conveyed to the registration roller pair 2.

The pickup roller 21, the feed roller 22, and the registration roller pair 2 are rotated by driving force from the motor M1. The electromagnetic clutch C transmits or cuts off the driving force from the motor M1 to the pickup roller 21 and the feed roller 22.

Figure 2:
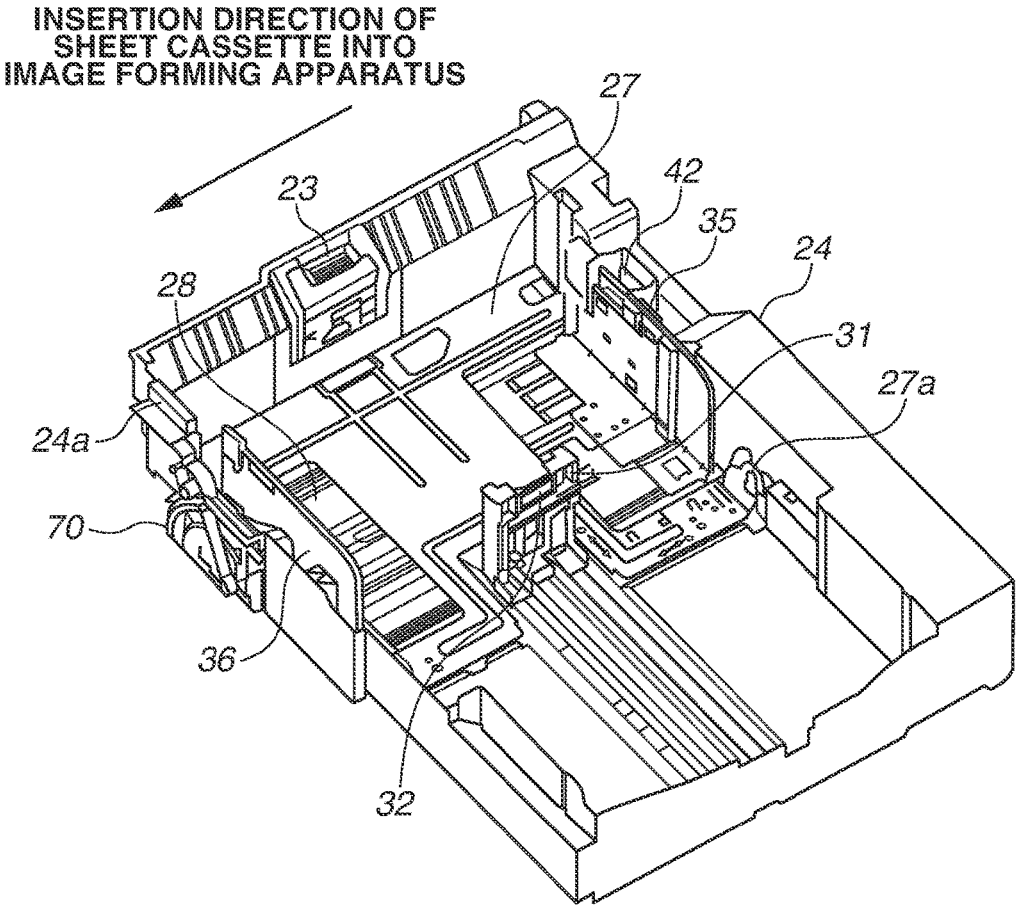
FIG. 2 is a perspective view illustrating a feeding cassette according to the first exemplary embodiment.
Figure 3:
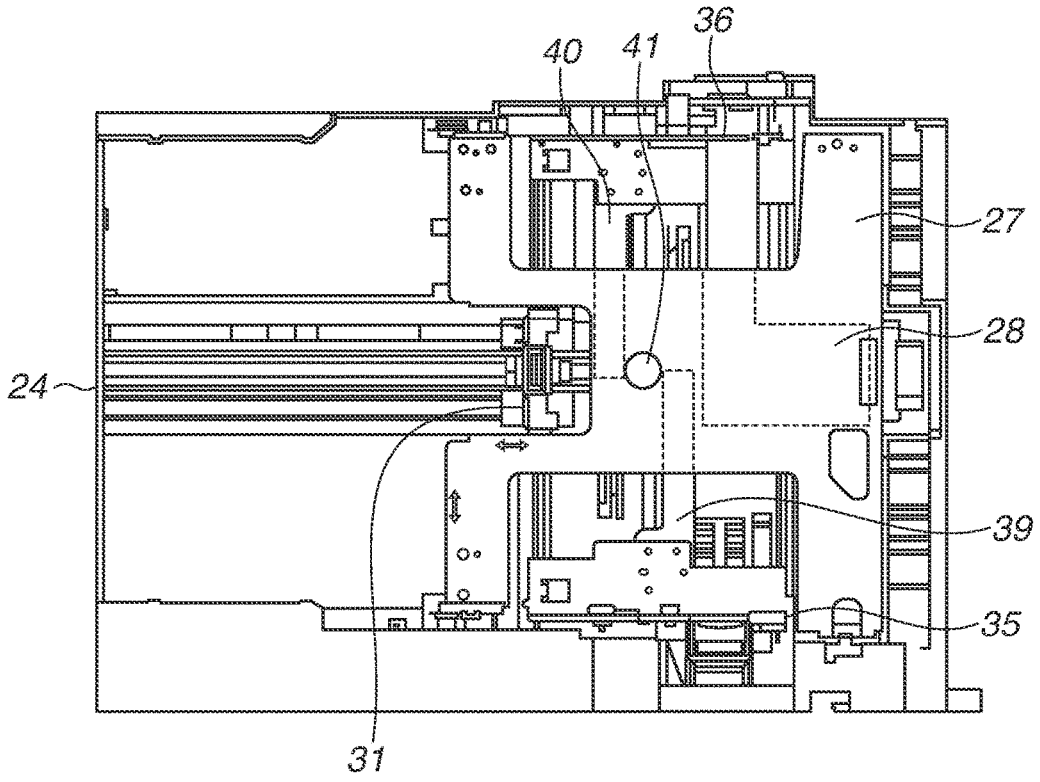
FIG. 3 is a top view illustrating the feeding cassette according to the first exemplary embodiment.

FIG. 2 is a perspective view of the feeding cassette 24. FIG. 3 is a cross-sectional view of the feeding cassette 24. The feeding cassette 24 can accommodate sheets S having a size of A6 to A4 in a feeding direction. The feeding cassette 24 can accommodate a plurality of sheets S, and includes a stacking plate 27 as a stacking member on which the sheets S are stacked. The stacking plate 27 can rotate (can be raised and lowered) about a rotation center 27*a*.

As illustrated in FIG. 3, a lift lever 28 that pushes up the stacking plate 27 toward the pickup roller 21 is disposed on a lower side of the stacking plate 27. A leading edge of the lift lever 28 is in contact with a center portion of a bottom surface of the stacking plate 27. The lift lever 28 rotates the stacking plate 27 upward and downward by the rotation of the cassette gear 70 illustrated in FIG. 2 disposed on a downstream side in a mounting direction of the feeding cassette 24. A cassette gear 70 is coupled to a drive transmission gear (not illustrated) of the image forming apparatus 1. The drive transmission gear provided to the image forming apparatus 1 is rotationally driven by the motor M2. The drive transmission gear meshes with the cassette gear 70 provided to the feeding cassette 24, when the feeding cassette 24 is mounted to the apparatus main body.

According to the first exemplary embodiment, the feeding cassette 24 can be mounted to and pulled out from the image forming apparatus 1, in a direction orthogonal to the direction in which the sheet S is fed by the pickup roller 21. Upstream and downstream sides in the mounting direction of the feeding cassette 24 are respectively defined as the front and rear sides of the apparatus main body.

As illustrated in FIG. 2, the feeding cassette 24 is provided with a trailing edge regulating member 31 that regulates a position of the trailing edge, which is the upstream end in the feeding direction, of the sheet S on the stacking plate 27. The trailing edge regulating member 31 can slide in the feeding direction of the sheet S and in the opposite direction. The trailing edge regulating member 31 is provided so as to be disposed at a position corresponding to the size of the sheet S through an operation on an operation lever 32 of the trailing edge regulating member 31 by a user.

The feeding cassette 24 is further provided with a front side regulating plate 35 and a rear side regulating plate 36 that regulate positions of end portions of the sheet S on the stacking plate 27 in a width direction orthogonal to the feeding direction. The front side regulating plate 35 and the rear side regulating plate 36 are slidable in the width direction, and form a side end regulating member pair. As illustrated in FIG. 3, the front side regulating plate 35 and the rear side regulating plate 36 respectively include rack portions 39 and 40 that are coupled to each other via a pinion gear 41. Thus, when the user operates an operation lever (operation member) 42 provided to the front side regulating plate 35, the front side regulating plate 35 and the rear side regulating plate move in association with each other in the width direction.

The feeding apparatus 20 includes a lock mechanism that locks the trailing edge regulating member 31 and the side end regulating member pair at various positions corresponding to the size of the sheet S. As described above, the operation lever 42 that locks and unlocks the front side regulating plate 35 and the rear side regulating plate 36 is provided to the front side regulating plate 35. Thus, the rear side regulating plate 36 serves as a reference position (reference position for forming an image on the sheet S) of the sheet S in the width direction.

Figure 4:
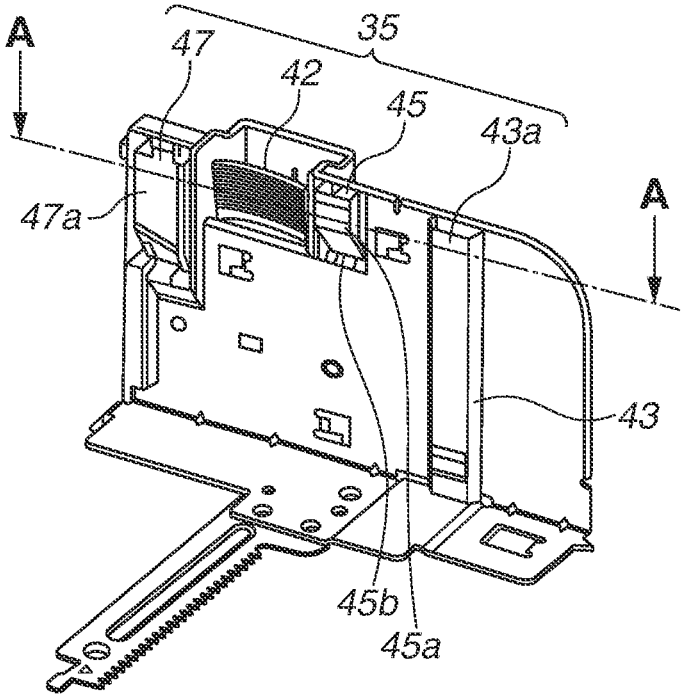
FIG. 4 is a perspective view illustrating a front side regulating member according to the first exemplary embodiment.
Figure 5:
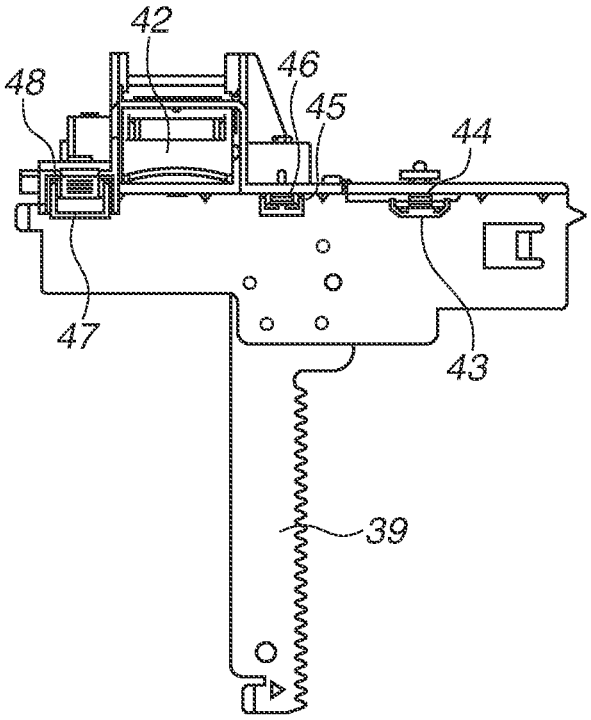
FIG. 5 is a cross-sectional view illustrating the front side regulating member according to the first exemplary embodiment.

FIG. 4 is a perspective view of the front side regulating plate 35, and FIG. 5 is a cross-sectional view taken along a section A-A illustrated in FIG. 4.

Even the sheets S of the same size differ in width (dimension error), and thus a gap might be formed between the side end of the sheets S and the side end regulating member. As illustrated in FIG. 4, the front side regulating plate 35 is provided with a pressing plate 43. The pressing plate 43 is elastically biased toward the downstream side in the mounting direction of the feeding cassette 24 by a pressing spring 44 as an elastic member, and protrudes from the front side regulating plate 35. A sheet pressing portion 43*a* of the pressing plate 43 presses the side end of the sheets S toward the downstream side in the mounting direction of the feeding cassette 24 (toward the rear side regulating plate 36). Thus, the position of the sheet S in the width direction can be regulated, without producing the gap between the side end of the sheet S and the side end regulating member.

A downstream pressing plate 47 is attached to a downstream side of the front side regulating plate 35 in the feeding direction. The downstream pressing plate 47 is elastically biased toward the downstream side in the mounting direction of the feeding cassette 24 by a pressing spring 48 as an elastic member. A sheet pressing portion 47*a* of the downstream pressing plate 47 can regulate the position of the sheet S in the width direction, at a position on the downstream side of the fed sheet S in the feeding direction. The pressing plate 43 and the downstream pressing plate 47 can integrally move with the front side regulating plate 35 in the insertion and mounting directions of the feeding cassette 24.

<Description on Upper Pressing Plate>

The front side regulating plate 35 is provided with an upper pressing plate (contact member) 45. In a case where the amount (height) of the sheets S stacked on the stacking plate 27 is equal to or more than a full stacked amount (predetermined amount) (when the position of the upper most one of the sheets S stacked on the stacking plate 27 is at a position that is equal to or higher than a predetermined position), the upper pressing plate 45 presses the sheets S at a position equal to or higher than the full stacked position. The upper pressing plate 45 is elastically biased toward the downstream side in the mounting direction of the feeding cassette 24 by a pressing spring 46 as an elastic member. A pressing surface 45*a* of the upper pressing plate 45 presses the sheets S that are equal to or higher than the full stacked position toward the downstream side (toward the rear side regulating plate 36) in the mounting direction. Generally, a mark is formed on the rear side regulating plate 36 so that the user can recognize the full stacked position of the sheets S.

Figure 6:
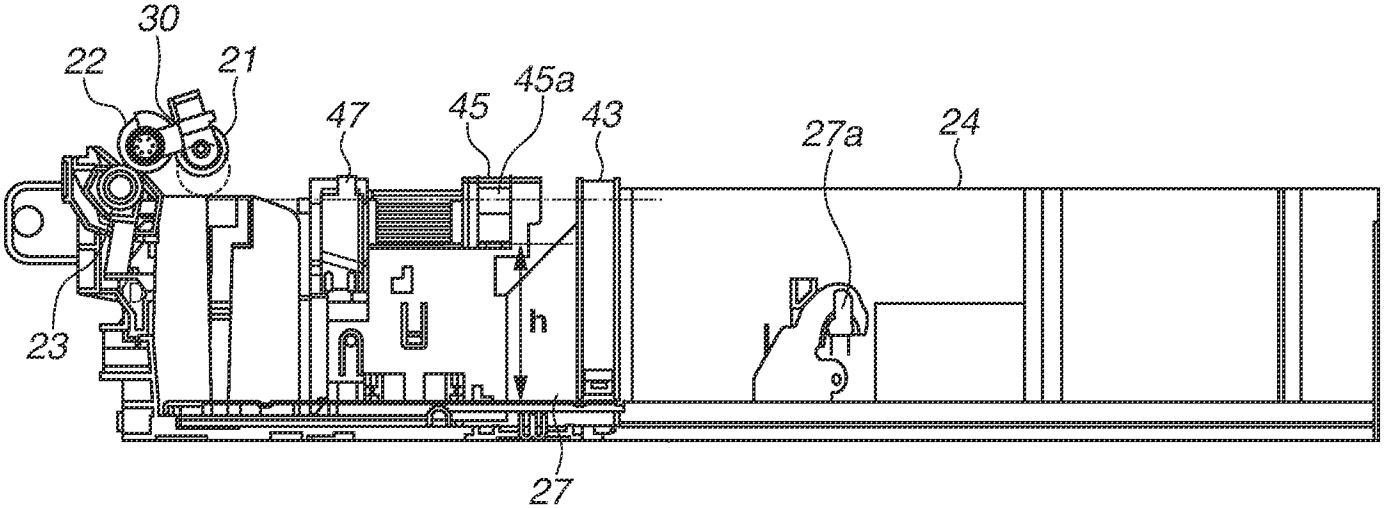
FIG. 6 is a cross-sectional view illustrating a feeding apparatus according to the first exemplary embodiment.
Figure 7B:
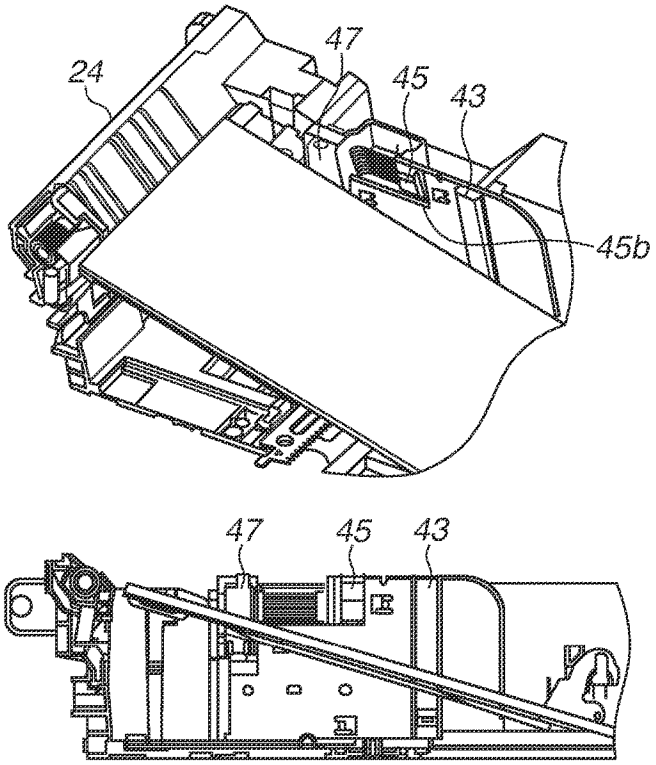
FIGS. 7A and 7B are perspective views each illustrating the feeding apparatus according to the first exemplary embodiment.
Figure 7A:
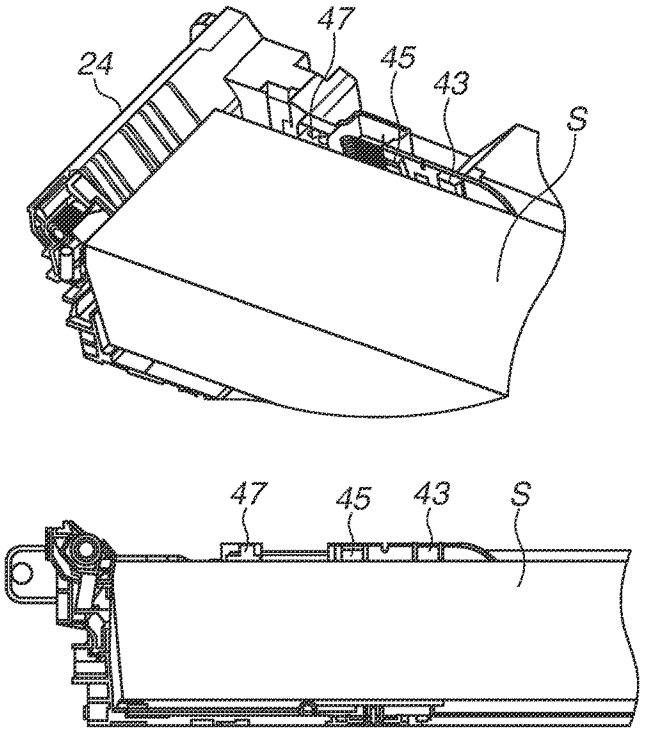

FIG. 6 is a cross-sectional view of the feeding apparatus 20. FIGS. 7A and 7B are perspective views each illustrating a state where the sheets S are stacked on the stacking plate 27. A holder 30 holds the pickup roller 21 and the feed roller 22. The pickup roller 21 can move (lowered and raised) between a first position (position indicated by a dashed line illustrated in FIG. 6) to feed the sheet S and a second position (position indicated by a solid line illustrated in FIG. 6) to be retracted to the upper side from the first position.

The lowermost surface (lowermost point) of the pressing surface 45*a* of the upper pressing plate 45 is lower than the lowermost surface of the lowered pickup roller 21 (dashed dotted line illustrated in FIG. 6), in the thickness direction of the sheets S. The uppermost point of the pressing surface 45*a* is higher than the lowermost point of the lowered pickup roller 21 in the thickness direction of the sheets S. Thus, as illustrated in FIG. 7A, the upper pressing plate 45 comes into contact with the sheet S, in a case where the amount of the sheets S stacked on the stacking plate 27 is equal to or more than the predetermined amount.

A section (clearance h illustrated in FIG. 6), in which the side end of the sheets S is not pressed, is disposed between the lowermost surface of the upper pressing plate 45 and the upper surface of the stacking plate 27. Thus, as illustrated in FIG. 7B, the upper pressing plate 45 does not come into contact with the sheet S, in a case where the amount of the sheets S stacked on the stacking plate 27 is less than the predetermined amount (in a case where the position of the uppermost one of the sheets S stacked on the stacking plate 27 is lower than the predetermined position). The upper pressing plate 45 is disposed at such a position thereby can strongly press the sheets S, in a case where the amount of the sheets S stacked on the stacking plate 27 is equal to or more than the predetermined amount. In other words, in a case where the upper pressing plate 45 is disposed over the entire area in the thickness direction of the sheets S, the pressing force of the upper pressing plate 45 on the sheets S is reduced by a sheet bundle on a lower side in the thickness direction of the sheets S. The upper pressing plate 45 is disposed at a position on the downstream side than the rotational center 27*a* of the stacking plate 27 and on the upstream side of the pickup roller 21 in the feeding direction.

The lower surface of the upper pressing plate 45 is provided with a tapered portion 45*b* having a tapered shape as viewed in the feeding direction. Thus, when the stacking plate 27 rises and the stacked sheets S come into contact with the upper pressing plate 45, the upper pressing plate 45 can smoothly move in the width direction.

A configuration of a first movement unit is described with reference to FIG. 8 to FIGS. 10A and 10B. The first movement unit mechanically moves the pickup roller 21 between the first and the second positions in association with the operations of mounting and pulling out the feeding cassette 24 to and from the apparatus main body.

According to the first exemplary embodiment, when the feeding cassette 24 is mounted to the image forming apparatus 1, the pickup roller 21 is at the first position (feeding position). The pickup roller 21 is at the second position (retracted position) when the feeding cassette 24 has been pulled out from the image forming apparatus 1.

Figure 8:
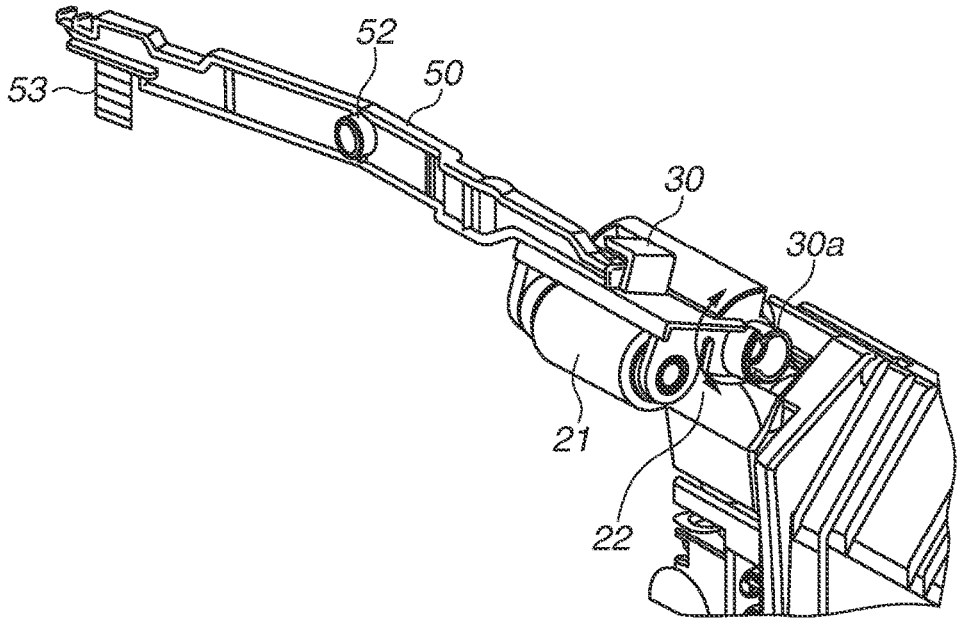
FIG. 8 is a perspective view illustrating a first movement unit according to the first exemplary embodiment.

FIG. 8 to FIGS. 10A and 10B are diagrams illustrating the first movement unit that mechanically moves the pickup roller 21. FIG. 8 is a diagram illustrating a configuration for biasing the pickup roller 21 to the first position. In FIG. 8, components such as a release lever 51 are omitted for simplifying the illustration.

The pickup roller 21 held by the holder 30 can be risen and lowered between the first position and the second position about a rotation center 30*a* of the holder 30. The pressing lever 50 has one end side elastically biased upward in FIG. 8 by a pressing spring 53. Thus, the other end side of the pressing lever 50 that rotates about a rotational center 52 presses the pickup roller 21 in a direction in which the pickup roller 21 presses the sheets S (direction in which the pickup roller 21 rotates downward about the rotational center 30*a*) through the holder 30.

Figure 9A:
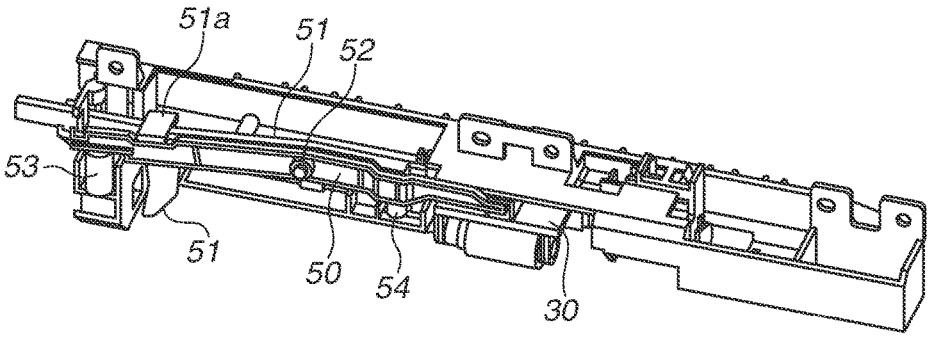
FIGS. 9A and 9B are diagrams each illustrating an operation of the first movement unit according to the first exemplary embodiment.
Figure 9B:
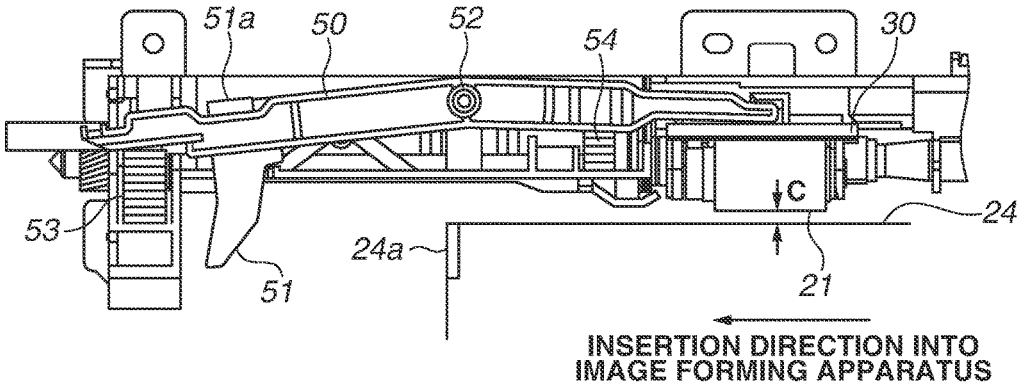

FIGS. 9A and 9B are diagrams each illustrating a state where the feeding cassette 24 has been pulled out from the apparatus main body. FIG. 9A is a perspective view and FIG. 9B is a cross-sectional view. In this state, the pickup roller 21 is at the second position.

As illustrated in FIGS. 9A and 9B, the release lever 51 that can rotate about the rotational center 52 is elastically biased upward (in the anticlockwise direction) by a release spring (elastic member) 54. The release lever 51 includes a contact portion 51*a* for the pressing lever 50, and biases the pressing lever 50 in the anticlockwise direction in FIG. 9B with the contact portion 51*a*. Thus, the release spring 54 elastically biases the pickup roller 21 so that the pickup roller 21 is lowered.

The moment M1, which is applied by the release spring 54 to bias the release lever 51 in the anticlockwise direction, is larger than the moment M2, which is applied by the pressing spring 53 to bias the pressing lever 50 in the clockwise direction. Thus, the pressing lever 50 rotates in the anticlockwise direction in FIG. 9B about the rotational center 52. Accordingly, the pickup roller 21 is at the second position in the state where the feeding cassette 24 has been pulled out from the image forming apparatus 1.

Figure 10A:
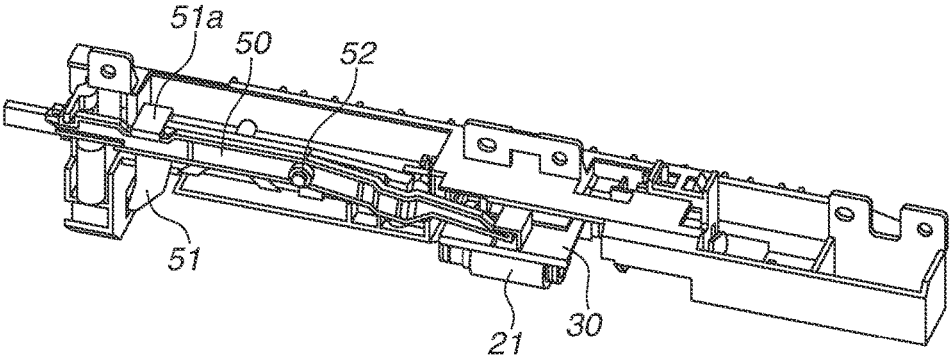
FIGS. 10A and 10B are diagrams each illustrating an operation of the first movement unit according to the first exemplary embodiment.
Figure 10B:
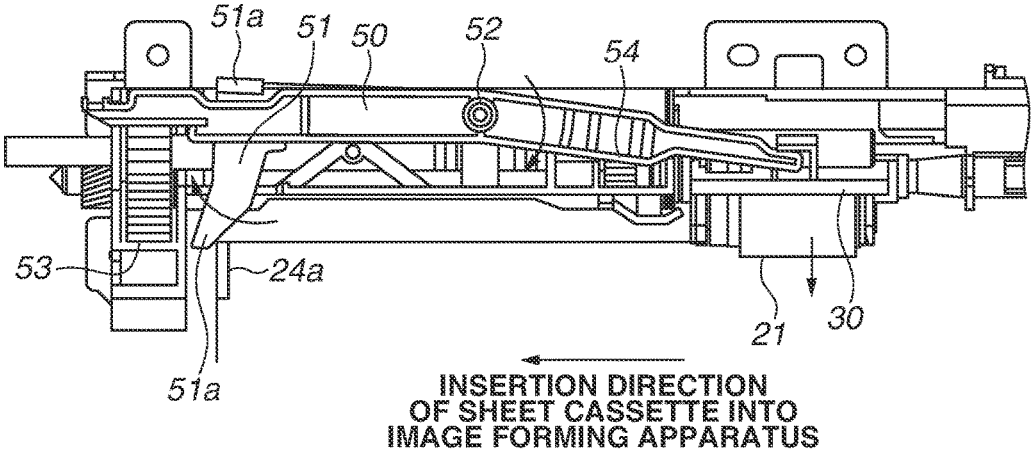

FIGS. 10A and 10B are diagrams each illustrating a state where the feeding cassette 24 is mounted to the image forming apparatus 1. FIG. 10A is a perspective view and FIG. 10B is a cross-sectional view. In this state, the pickup roller 21 is at the first position.

During the operation of mounting the feeding cassette 24 to the image forming apparatus 1, a contact portion 24*a* of the feeding cassette 24 presses a contacted portion 51*b* of the release lever 51 against the elastic force of the release spring 54. Thus, the release lever 51 rotates in a direction indicated by an arrow illustrated in FIG. 10B to a position where the contact portion 51*a* of the release lever 51 no longer contacts the pressing lever 50. As a result, the pressing lever 50 receives the elastic force only from the pressing spring 53. Thus, as described above, the pressing lever 50 presses the holder 30 downward, whereby the pickup roller 21 moves to the first position to be pressed by the sheets S.

As described above, according to the first exemplary embodiment, the pickup roller 21 mechanically moves from the second position to the first position, in response to the operation of mounting the feeding cassette 24 to the image forming apparatus 1. The pickup roller 21 mechanically moves from the first position to the second position, in association with the operation of pulling the feeding cassette 24 out from the image forming apparatus 1.

Figure 11A:
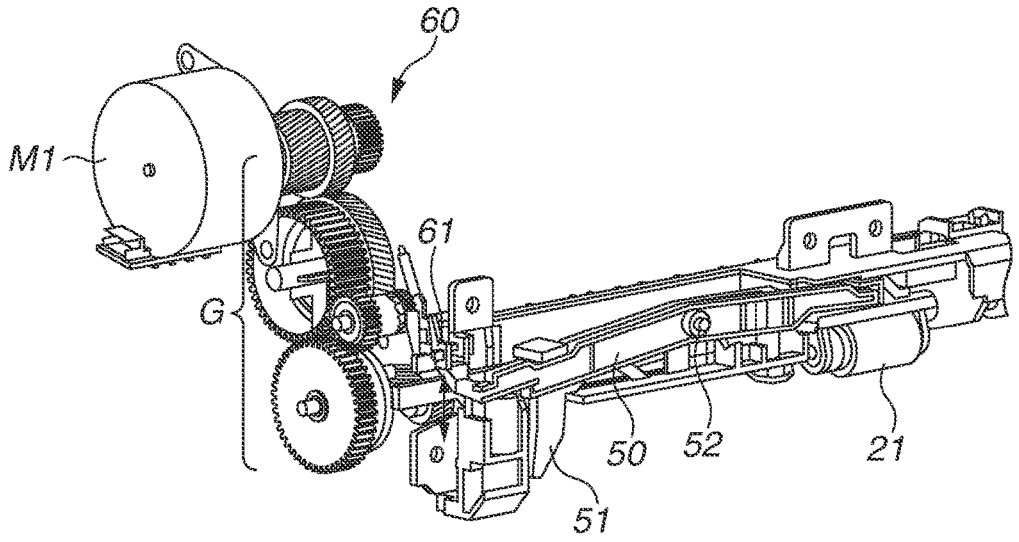
FIGS. 11A and 11B are diagrams each illustrating an operation of a second movement unit according to the first exemplary embodiment.

A second movement unit 60 is described with reference to FIGS. 11A and 11B. The second movement unit electrically moves the pickup roller 21 between the first and the second positions. In other words, the second movement unit 60 switches a positional relationship between the pickup roller 21 and the stacking plate 27 between first and second positional relationships. The pickup roller 21 and the stacking plate 27 are farther apart from each other in the second positional relationship than in the first positional relationship. FIG. 11A is a perspective view illustrating the second movement unit 60 and FIG. 11B is a cross-sectional view illustrating the second movement unit 60.

The feeding apparatus 20 according to the first embodiment includes the second movement unit 60. The second movement unit 60 electrically moves the pickup roller 21 between the first and the second positions when the feeding cassette 24 is mounted to the color image forming apparatus 1. As illustrated in FIG. 11A, the second movement unit 60 includes the motor M1 that can rotate in normal and reverse directions, a gear train G, and a slide member 61. The slide member 61 moves upward and downward upon receiving driving force, generated by the motor M1, via the gear train G. When the CPU 110 rotates the motor M1 in the normal direction, the slide member 61 moves upward. On the other hand, when the CPU 110 rotates the motor M1 in the reverse direction, the slide member 61 moves downward.

Figure 11B:
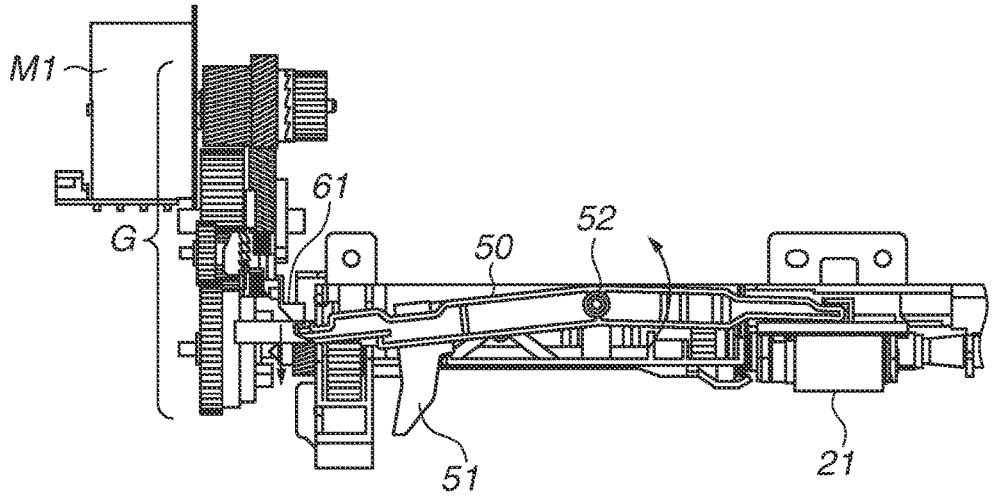

When the CPU 110 rotates the motor M1 in the reverse direction, the slide member 61 moves downward to press one end side of the pressing lever 50 downward, whereby the pressing lever 50 rotates in the anticlockwise direction in FIG. 11B about the rotational center 52. Thus, the pickup roller 21 moves to the second position to be retracted upward from the first position.

When the CPU 110 rotates the motor M1 in the normal direction, the slide member 61 moves upward to be separated from the pressing lever 50, whereby the pressing lever 50 rotates in the clockwise direction in FIG. 11B about the rotational center 52. Thus, the pickup roller 21 moves downward from the second position to the first position.

Figure 12:
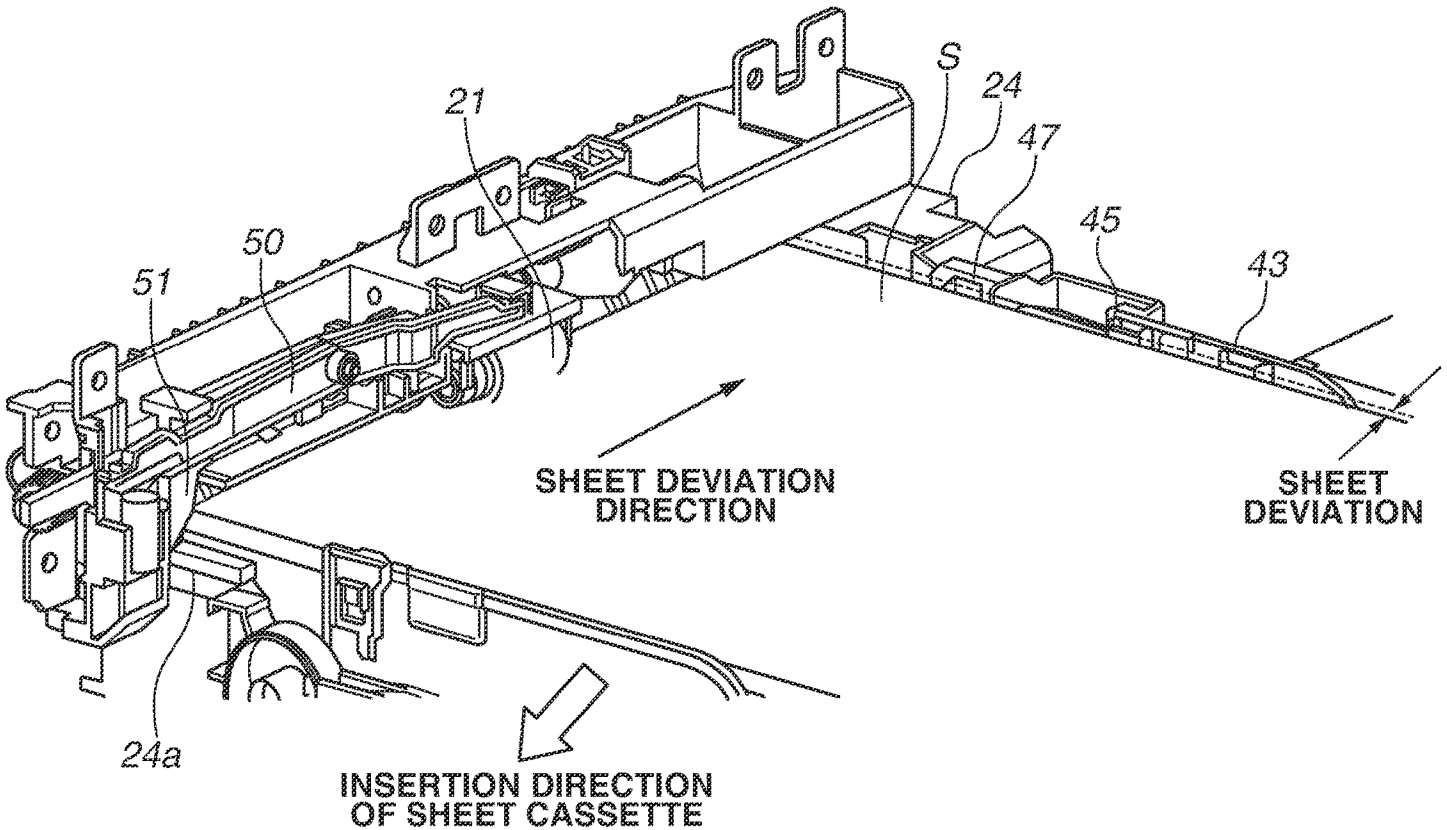
FIG. 12 is a perspective view illustrating the feeding apparatus according to the first exemplary embodiment.

An operation is described that is performed when the feeding cassette 24 is mounted to the image forming apparatus 1 in a state where the height of the sheets S stacked on the stacking plate 27 of the feeding cassette 24 is higher than the full stacked position with reference to FIG. 12.

As described above, according to the first exemplary embodiment, the contact portion 24*a* of the feeding cassette 24 presses the release lever 51 in the operation of mounting the feeding cassette 24 to the image forming apparatus 1. Thus, the pickup roller 21 starts move downward from the second position. When the feeding cassette 24 is inserted to a predetermined mounted position in the image forming apparatus 1, the movement of the pickup roller 21 from the second position to the first position is completed.

In the state where the height of the sheets S stacked on the stacking plate 27 is equal to or higher than the full stacked position, the distance (distance C illustrated in FIG. 9B) from the pickup roller 21 to the uppermost surface of the sheets S is small compared with a state where a normal amount of sheets S is stacked. Thus, in the operation of mounting the feeding cassette 24 to the image forming apparatus 1, the pickup roller 21 comes into contact with the uppermost surface of the sheets S before the feeding cassette 24 reaches the predetermined mounted position in the image forming apparatus 1.

In a case where the pickup roller 21 comes into contact with the uppermost surface of the sheets S before the feeding cassette 24 reaches the predetermined mounted position in the image forming apparatus 1, the positions of the uppermost sheet S and the adjacent sheet S are deviated in an opposite direction of an insertion direction of the feeding cassette 24 (a direction indicated by an arrow illustrated in FIG. 12 indicating sheet deviation direction). This is because the pickup roller 21 hinders the movement of the sheets S, which are accommodated in the feeding cassette 24, in the insertion direction of the feeding cassette 24.

The sheets S are biased toward the downstream side in the insertion direction of the feeding cassette 24 by the pressing plates 43, 45, and 47 provided to the front side regulating plate 35. However, the pressing force of the pressing plates 43, 45, and 47 might not be strong enough to support the sheets S. Thus, the sheets S cannot be pressed toward the rear side regulating plate 36. As a result, the position of the sheet S is deviated in the width direction (the opposite direction of the mounting direction of the feeding cassette 24).

Thus, according to the first exemplary embodiment, the CPU 110 operates the second movement unit 60 before the feeding operation of the sheet S is performed. More specifically, the CPU 110 controls the rotation of the motor M1, when the insertion detection unit 55 detects that the feeding cassette 24 is mounted to the image forming apparatus 1. The CPU 110 rotates the motor M1 in the reverse direction to move the pickup roller 21 to the second position to be temporary separated from the sheet S. Then, the CPU 110 rotates the motor M1 in the normal direction to move the pickup roller 21 to the first position to be in contact with the sheet S again.

With the pickup roller 21 temporarily separated from the sheet S by the second movement unit 60, the upper pressing plate 45 presses the sheets S toward the rear side regulating plate 36. Thus, the deviation of the position of the sheets S in the width direction can be corrected.

Then, the feeding operation is performed after the pickup roller 21 is moved again to the first position. Thus, the deviation of the printing position with respect to the sheet S and the paper jam due to the collision of the sheet S with a guide and the like on the conveyance path can be prevented. According to the first exemplary embodiment, the feeding pressure applied by the pickup roller 21 to the sheets S stacked on the stacking plate 27 is set in such a manner that double feed can be prevented even when the amount of the stacked sheets S is equal to or more than the full stacked amount.

As described above, according to the first exemplary embodiment, the deviation of the position of the sheets S due to the operation of mounting the feeding cassette 24 can be corrected before the operation of feeding the sheet S. Thus, a distance between the lower surface position of the pickup roller 21 and the uppermost surface of the stacked sheets S, which is required to be large enough in conventional printers, can be made short. Accordingly, the feeding apparatus 20 and the image forming apparatus 1 can be downsized in the height direction.

According to the first exemplary embodiment described above, the stacking plate 27 rotates about the rotational center 27*a*. However, the present invention is not limited to this. For example, the present invention may employ a configuration in which the stacking plate is raised by moving in a parallel manner, as in the configuration discussed in Japanese Patent No. 3483319.

According to the first exemplary embodiment described above, the pickup roller 21 is raised and lowered by driving force of the motor M1. Alternatively, the present invention may employ a configuration for raising and lowering the pickup roller 21 by using a solenoid or the like.

According to the first exemplary embodiment, the positions (the first and second positions) to which the pickup roller 21 is moved by the first movement unit are the same as the positions to which the pickup roller 21 is moved by the second movement unit 60. However, the present invention is not limited to this configuration.

Figure 13A:
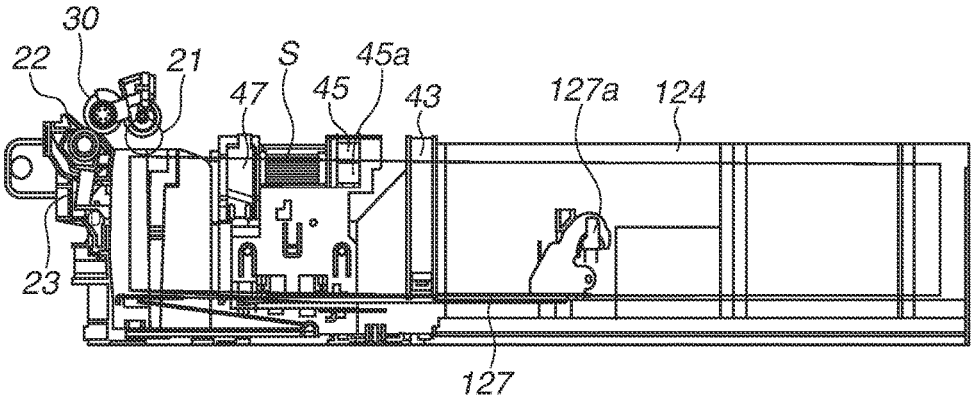
FIGS. 13A and 13B are cross-sectional views each illustrating a feeding apparatus according to a second exemplary embodiment.
Figure 13B:
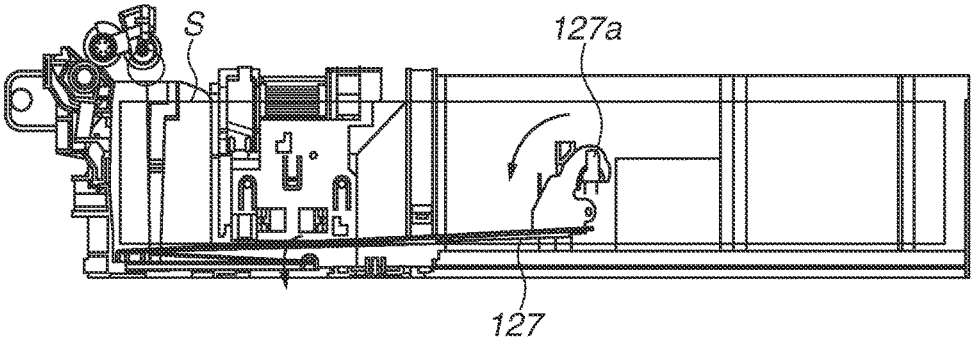

A second exemplary embodiment to which the present invention is applied is described with reference to FIGS. 13A and 13B. In the second exemplary embodiment described below, the description of the configuration and the operation that are the same as the counterparts in the first exemplary embodiment is omitted.

According to the first exemplary embodiment, the second movement unit 60 raises the pickup roller 21 to temporarily separate the pickup roller 21 from the sheets S before the feeding operation of the sheets S is performed.

According to the second exemplary embodiment, the stacking plate 127 is lowered to separate the pickup roller 21 from the sheets S before the feeding operation of the sheets S is performed. Then, the upper pressing member 45 presses the sheets S toward the rear side regulating plate 36, whereby the positions of the sheets S in the width direction are corrected.

More specifically, according to the second exemplary embodiment, the CPU 110 rotates the motor M2 in a direction opposite to the direction in which the stacking plate 27 is raised. Thus, the stacking plate 27 is lowered from a state illustrated in FIG. 13A, whereby a state illustrated in FIG. 13B is achieved. As a result, the sheets S stacked on the stacking plate 27 are separated from the pickup roller 21, and the upper pressing member 45 presses the sheets S toward the rear side regulating plate 36. Then, the CPU 110 rotates the motor M2 in the direction in which the stacking plate 27 is raised.

The second exemplary embodiment described above can provide the same effect as in the first exemplary embodiment.

According to the first and the second exemplary embodiments described above, the motor M2 dedicated to raising the stacking plate 27 is provided. However, the present invention is not limited to this configuration. The present invention may be applied to a configuration of raising the stacking plate 27 by transmitting the driving force generated by the motor M1, in charge of the rotation of the pickup roller 21 and the like, to the stacking plate 27.

According to the first and the second exemplary embodiments described above, the image forming unit that forms an image on a sheet employs an electrophotographic image forming process as an example. However, the present invention is not limited to the image forming unit employing the electrophotographic image forming process. For example, the image forming unit may employ an inkjet image forming process of discharging ink droplets from nozzles to form an image on a sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-139873, filed Jul. 7, 2014, which is hereby incorporated by reference herein in its entirety.

What is claimed is:

1. A feeding apparatus comprising:

an apparatus main body;

a feeding cassette configured to be inserted into and pulled out from the apparatus main body;

a stacking member provided to the feeding cassette and configured to have sheets stacked on the stacking member;

a feeding member configured to be raised and lowered and to feed the sheets stacked on the stacking member;

a regulating member provided movably on the feeding cassette and configured to regulate a position of the sheets stacked on the stacking member;

a first contact plate having a surface and provided on the regulating member and configured to come into contact with the sheets stacked on the stacking member;

an elastic portion configured to elastically bias the first contact portion toward the sheets stacked on the stacking member;

a second contact plate having a surface and provided on the regulating member and configured to come into contact with the sheets stacked on the stacking member on an upstream side, in a direction of sheet feeding by the feeding member, of the first contact portion; and a third contact plate having a surface and provided on the regulating member and configured to come into contact with the sheets stacked on the stacking member on a downstream side, in the direction of sheet feeding by the feeding member, of the first contact portion, wherein, in a height direction of the sheets stacked on the stacking member, the entire surface in contact with the sheet of the third contact plate is shorter than the entire surface in contact with the sheet of the second contact plate, and the entire surface in contact with the sheet of the first contact plate is shorter than the entire surface in contact with the sheet of the third contact plate, and wherein the first contact plate is disposed at a position where, in a case where an amount of sheets stacked on the stacking member is equal to or more than a predetermined amount, the first contact plate comes into contact with the sheets stacked on the stacking member, and, in a case where the amount of the sheets stacked on the stacking member is less than the predetermined amount, the first contact plate does not come into contact with the sheets stacked on the stacking member.

2. The feeding apparatus according to claim 1, further comprising a first movement unit configured to raise the feeding member in accordance with an operation of pulling the feeding cassette out from the apparatus main body, and to lower the feeding member in accordance with an operation of inserting the feeding cassette into the apparatus main body.

3. The feeding apparatus according to claim 2, further comprising a switching unit that includes a driving source configured to generate driving force and is configured to use the driving force of the driving source to switch a positional relationship between the feeding member and the stacking member between a first positional relationship and a second positional relationship, wherein the feeding member and the stacking member are disposed farther apart from each other in the second positional relationship than in the first positional relationship.

4. The feeding apparatus according to claim 3, further comprising a control unit configured to control, after the feeding member is lowered in accordance with the operation of inserting the feeding cassette into the apparatus main body and before the feeding member performs a feeding operation of the sheets, the switching unit in such a manner that the positional relationship between the feeding member and the stacking member is switched to the second positional relationship from the first positional relationship.

5. The feeding apparatus according to claim 4, further comprising an insertion detection unit configured to detect that the feeding cassette is inserted into the apparatus main body, wherein the control unit controls the switching unit based on the insertion detection unit detecting that the feeding cassette is inserted into the apparatus main body.

6. The feeding apparatus according to claim 4, wherein the control unit controls the switching unit in such a manner that the positional relationship between the feeding member and the stacking member is switched to the first positional relationship from the second positional relationship after the positional relationship is switched from the first positional relationship to the second positional relationship.

7. The feeding apparatus according to claim 4, wherein the switching unit is configured to switch the positional relationship between the feeding member and the stacking member between the first positional relationship and the second positional relationship by raising and lowering of the feeding member.

8. The feeding apparatus according to claim 4, wherein the switching unit is configured to switch the positional relationship between the feeding member and the stacking member between the first positional relationship and the second positional relationship by raising and lowering of the stacking member.

9. The feeding apparatus according to claim 1, wherein the feeding member feeds the sheets in a direction orthogonal to an insertion direction of the feeding cassette.

10. An image forming apparatus comprising:

an apparatus main body that includes an image forming unit configured to form an image on a sheet being conveyed;

a feeding cassette configured to be inserted into and pulled out from the apparatus main body;

a stacking member provided to the feeding cassette and configured to have sheets stacked on the stacking member;

a feeding member configured to be raised and lowered and to feed the sheets stacked on the stacking member to the image forming unit;

a regulating member provided movably on the feeding cassette and configured to regulate a position of the sheets stacked on the stacking member;

a first contact plate having a surface and provided on the regulating member and configured to come into contact with the sheets stacked on the stacking member;

an elastic portion configured to elastically bias the first contact portion toward the sheets stacked on the stacking member;

a second contact plate having a surface and provided on the regulating member and configured to come into contact with the sheets stacked on the stacking member on an upstream side, in a direction of sheet feeding by the feeding member, of the first contact portion; and a third contact plate having a surface and provided on the regulating member and configured to come into contact with the sheets stacked on the stacking member on a downstream side, in the direction of sheet feeding by the feeding member, of the first contact portion, wherein, in a height direction of the sheets stacked on the stacking member, the entire surface in contact with the sheet of the third contact plate is shorter than the entire surface in contact with the sheet of the second contact plate, and the entire surface in contact with the sheet of the first contact plate is shorter than the entire surface in contact with the sheet of the third contact plate, and wherein the first contact plate is disposed at a position where the first contact portion comes into contact with the sheets stacked on the stacking member in a case where an amount of sheets stacked on the stacking member is equal to or more than a predetermined amount, and the first contact plate does not come into contact with the sheets stacked on the stacking member in a case where the amount of the sheets stacked on the stacking member is less than the predetermined amount.

11. The image forming apparatus according to claim 10, further comprising a first movement unit configured to raise the feeding member in accordance with an operation of pulling the feeding cassette out from the apparatus main body, and to lower the feeding member in accordance with an operation of inserting the feeding cassette into the apparatus main body.

12. The image forming apparatus according to claim 11, further comprising a switching unit that includes a driving source configured to generate driving force and is configured to use the driving force of the driving source to switch a positional relationship between the feeding member and the stacking member between a first positional relationship and a second positional relationship, wherein the feeding member and the stacking member are disposed farther apart from each other in the second positional relationship than in the first positional relationship.

13. The image forming apparatus according to claim 12, further comprising a control unit configured to control, after the feeding member is lowered in accordance with the operation of inserting the feeding cassette into the apparatus main body and before the feeding member performs a feeding operation of the sheets, the switching unit in such a manner that the positional relationship between the feeding member and the stacking member is switched to the second positional relationship from the first positional relationship.

14. The image forming apparatus according to claim 13, further comprising an insertion detection unit configured to detect that the feeding cassette is inserted into the apparatus main body, wherein the control unit controls the switching unit based on the insertion detection unit detecting that the feeding cassette is inserted into the apparatus main body.

15. The image forming apparatus according to claim 13, wherein the control unit controls the switching unit in such a manner that the positional relationship between the feeding member and the stacking member is switched to the first positional relationship from the second positional relationship after the positional relationship is switched from the first positional relationship to the second positional relationship.

16. The image forming apparatus according to claim 13, wherein the switching unit is configured to switch the positional relationship between the feeding member and the stacking member between the first positional relationship and the second positional relationship by raising and lowering of the feeding member.

17. The image forming apparatus according to claim 13, wherein the switching unit is configured to switch the positional relationship between the feeding member and the stacking member between the first positional relationship and the second positional relationship by raising and lowering of the stacking member.

18. The image forming apparatus according to claim 10, wherein the feeding member feeds the sheets in a direction orthogonal to an insertion direction of the feeding cassette.

* * * * *